US006223994B1

(12) United States Patent
Fukuda et al.

(10) Patent No.: US 6,223,994 B1
(45) Date of Patent: May 1, 2001

(54) THERMAL EXPANSION VALVE

(75) Inventors: Eiji Fukuda; Kazuhiko Watanabe, both of Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/549,916

(22) Filed: Apr. 14, 2000

(30) Foreign Application Priority Data

May 11, 1999 (JP) ..... 11-130312

(51) Int. Cl.[7] ..... F25B 41/04
(52) U.S. Cl. ..... 236/92 B; 62/225; 236/99 D
(58) Field of Search ..... 62/225; 236/92 B, 236/99 D

(56) References Cited

U.S. PATENT DOCUMENTS 2,385,243 * 9/1945 Wiegers ..... 236/99 D
2,577,902 * 12/1951 McGrath ..... 236/99 D
3,366,330 * 1/1968 Ronk ..... 236/99 D
3,537,645 * 11/1970 Treder ..... 236/92 B
4,065,939 * 1/1978 Thronbery et al. ..... 236/92 B
5,228,619 * 7/1993 Yano et al. ..... 236/92 B
5,297,728 * 3/1994 Yano et al. ..... 236/92 B
5,361,597 * 11/1994 Hazime et al. ..... 236/92 B
5,943,871 * 8/1999 Ito et al. ..... 236/92 B
6,056,202 * 5/2000 Fujimoto et al. ..... 236/92 B
6,062,484 * 5/2000 Eybergen ..... 236/92 B

* cited by examiner

*Primary Examiner*—William E. Tapolcai
(74) *Attorney, Agent, or Firm*—R. Neil Sudol; Henry D. Coleman; William J. Sapone

(57) ABSTRACT

The invention provides a thermal expansion valve for a car air conditioner, which prevents a hunting phenomenon. The thermal expansion valve is provided with a refrigerant passage from an evaporator toward a compressor formed in an inner portion thereof and a temperature sensing and pressure transmitting member having a heat sensing function and forming a hollow portion in an inner portion thereof, which is installed in the passage. In the thermal expansion valve, a distal end of the hollow portion of the temperature sensing and pressure transmitting member is fixed to a center opening portion of a diaphragm constituting a power element portion for driving the temperature sensing and pressure transmitting member, an upper pressure chamber within the power element portion formed by the diaphragm and the hollow portion are communicated with each other so as to form a sealed space having a working fluid charged therein, and a thermal-transfer delay means is provided between a heat ballast member received in the hollow portion and an inner wall of the hollow portion.

4 Claims, 3 Drawing Sheets

PRIOR ART

PRIOR ART

THERMAL EXPANSION VALVE

FIELD OF THE INVENTION

The present invention relates to a thermal expansion valve used for a refrigerant cycle.

CONVENTIONAL ART

Conventionally, for the purpose of controlling a flow amount of a refrigerant supplied to an evaporator in a refrigerant cycle and decreasing a pressure of the refrigerant, a thermal expansion valve shown in FIG. 2 has been used.

In FIG. 2, a first refrigerant passage 514 on which an orifice 516 is formed and a second refrigerant passage 519 are provided in a rectangular cylindrical valve body 510 in a mutually independent manner. An end of the first refrigerant passage 514 is communicated with an inlet port of an evaporator 515, and an outlet port of the evaporator 515 is connected to another end of the first refrigerant passage 514 via the second refrigerant passage 519, a compressor 511, a condenser 512 and a receiver 513. Urging means 517 corresponding to a bias spring for urging a spherical valve member 518 engaged with and disengaged from the orifice 516 is provided in a valve chamber 514 communicating with the first refrigerant passage 514. In this case, the valve caliber 524 is sealed by a plug 525 and the valve member 518 is urged via a supporting portion 526. A power element 520 disposed adjacent to the second refrigerant passage 519 and having a diaphragm 522 is fixed to the valve body 510. An upper chamber 520*a* of the power element 520 partitioned by the diaphragm 522 is made air-tight, condition, and a temperature corresponding working fluid is charged therein.

A small pipe 521 extending from the upper chamber 520*a* of the power element 520 is sealed at an end portion thereof after being used for discharging an air from the upper chamber 520*a* and pouring a temperature corresponding working fluid into the upper chamber 520*a*. An extending end of a valve driving member 523 corresponding to a temperature sensing and pressure transmitting member extending through the second refrigerant passage 519 from the valve member 518 within the valve body 510 is arranged in a lower chamber 520*b* of the power element 520 and is brought into contact with the diaphragm 522. A valve driving member 523 is made of a material having a large heat capacity and transmits a temperature of a refrigerant vapor flowing through the second refrigerant passage 519 and discharged from the outlet port of the evaporator 515 to a temperature corresponding working fluid in the upper chamber 520*a* of the power element 520 so as to generate a working gas having a pressure corresponding to the temperature. The lower chamber 520*b* is communicated with the second refrigerant passage 519 via a gap in the periphery of the valve driving member 523 within the valve body 510.

Accordingly, the diaphragm 522 of the power element 520 adjusts a valve opening degree (that is, a flowing amount of a liquid refrigerant to the inlet port of the evaporator) of the valve member 518 with respect to the orifice 516 by means of the valve driving member 523 under an influence of an urging force of the urging means 517 for the valve member 518 in accordance with a difference between a pressure of the working gas in a temperature corresponding working fluid within the upper chamber 520*a* and a pressure of the refrigerant vapor in the outlet port of the evaporator 515 within the lower chamber 520*b*.

In the conventional thermal expansion valve mentioned above, the power element 520 is exposed to an external atmosphere, and a temperature corresponding working fluid within the upper chamber 520*a* is influenced not only by the temperature of the refrigerant disposed in the outlet port of the evaporator and transmitted by the valve driving member 523 but also by the external atmosphere, particularly, a temperature in an engine room. Further, there is readily generated a so-called hunting phenomenon in which opening and closing operations of the valve member 518 are frequently repeated due to an excessively sensitive response to the temperature of the refrigerant in the outlet port of the evaporator. This hunting is caused by a structure of the evaporator, a method of piping the refrigerant cycle, a method of using the thermal expansion valve, a balance to a thermal load and the like.

A heat ballast member has been conventionally employed as means for preventing the hunting phenomenon. FIG. 3 is a cross sectional view of a thermal expansion valve which uses the heat ballast member. The thermal expansion valve in FIG. 3 is widely different from the conventional thermal expansion valve in FIG. 2 in structures of the diaphragm and of the valve driving member corresponding to the temperature sensing and pressure transmitting member, and other structures are the same. In FIG. 3, the thermal expansion valve has a rectangular cylindrical valve body 50, and the valve body 50 is provided with a port 52 through which a liquid phase refrigerant flowing from the receiver tank 513 via the condenser 512 is introduced to a first passage 62, a port 58 which feeds out the refrigerant from the first passage 62 to the evaporator 515, an inlet port 60 of a second port 63 through which a gas phase refrigerant returning from the evaporator passes, and an outlet port 64 which feeds out the refrigerant to a side of the compressor 511.

The port 52 through which the liquid phase refrigerant is introduced is communicated with a valve chamber 54 provided on a center axis of the valve body 50 and the valve chamber 54 is sealed by a nut-shaped plug 130. The valve chamber 54 is communicated with the port 58 for feeding out the refrigerant to the evaporator 515 via an orifice 78. A spherical valve member 120 is placed at a distal end of a shaft 114 having a small diameter and extending through the orifice 78, the valve member 120 is supported by a supporting member 122, and the supporting member 122 urges the valve member 120 toward the orifice 78 by means of a bias spring 124. A flow passage area of the refrigerant can be adjusted by changing an interval formed between the valve member 120 and the orifice 78. The liquid phase refrigerant expands while passing through the orifice 78 and is fed out to the evaporator side from the port 58 through the first passage 62. The gas phase refrigerant returning from the evaporator is introduced from the port 60 and is fed out to the compressor side from the port 64 through the second passage 63.

The valve body 50 has a first hole 70 formed on an axis from an upper end portion thereof, and a power element portion 80 is mounted to the first hole by utilizing a screw portion or the like. The power element portion 80 has housings 81 and 91 constituting a temperature sensing portion and a diaphragm 82 gripped between the housings and adhered to the housing by means of a welding, and an upper end portion of a temperature sensing and pressure transmitting member 100 is mounted to a circular hole in a center portion of the diaphragm 82 together with a diaphragm supporting member 82' by welding all the periphery. In this case, the diaphragm supporting member 82' is supported by housing 81.

A refrigerant comprising gas and liquid phases which is the same as or similar to the refrigerant flowing within the passage 62 is charged within the housings 81 and 91 as a temperature corresponding working fluid, and is sealed by a small pipe 21 after being charged. In this case, in place of the small pipe 21, a plug body welded to the housing 91 may be used. Inner portions of the housings 81 and 91 are partitioned by the diaphragm 82, so that an upper chamber 83 and a lower chamber 85 are formed.

The temperature sensing and pressure transmitting member 100 is constituted by a hollow pipe member exposed within the second passage 63, and a heat ballast member 40 is received within the temperature sensing and pressure transmitting member 100. A top portion of the temperature sensing and pressure transmitting member 100 is communicated with the upper chamber 83, and a pressure space 83*a* is constructed by the upper chamber 83 and a hollow portion 84 of the temperature sensing and pressure transmitting member 100. The hollow pipe-like temperature sensing and pressure transmitting member 100 passes through a second hole 72 formed on the axis of the valve body 50 and is inserted into a third hole 74. A gap is formed between the second hole 72 and the temperature sensing and pressure transmitting member 100, and the refrigerant within the passage 63 is introduced into the lower chamber 85 of the diaphragm through the gap.

The temperature sensing and pressure transmitting member 100 is slidably inserted into the third hole 74, and a distal end thereof is connected to an end of the shaft 114. The shaft 114 is slidably inserted into a fourth hole 76 formed on the valve body 50, and another end thereof is connected to the valve member 120.

In the structure mentioned above, the heat ballast member functioning as a thermal-transfer-delay means as follows. That is, for example, in the case of using a granular activated carbon for the heat ballast member 40, a combination of a temperature corresponding working fluid and the heat ballast member 40 is of an adsorption equilibrium type in which a pressure can be approximated to a linear equation of a temperature in a wide temperature range and a coefficient of the linear equation can be freely set in accordance with an amount of the granular activated carbon charged as the heat ballast member 40, so that a user of the thermal expansion valve can freely set a characteristic of the thermal expansion valve.

Accordingly, in order to set a balancing state between a pressure and a temperature in the adsorption equilibrium type, a relatively long time is required in both of ascent and descent of the temperature of the refrigerant vapor discharged from the outlet port of the evaporator 515, that is, it is necessary to increase the time constant so as to stabilize a performance of an air conditioner which can restrict an excessive operation of the thermal expansion valve caused by an influence of a disturbance which is a reason for the hunting phenomenon, thereby Improving an operation efficiency of the air conditioner.

Further, for example, in the case of using an alumina silica sintered body for the heat ballast member, a combination of a temperature corresponding working fluid and the heat ballast member 40 is of a gas liquid equilibrium type. In this case, a change from a liquid phase to a gas phase (a gasification) of a temperature corresponding working fluid in one chamber 20*a* of the power element 20 which is inserted into a multiplicity of fine holes in the heat ballast member 40 is delayed when a temperature of the refrigerant vapor discharged from the outlet port of the evaporator 515 ascended, that is, a time constant is increased, and a working gas in a space except those in the upper chamber 83 and the heat ballast member 40 is prevented from quickly changing from the gas phase to the liquid phase (liquefying) on the wall surface thereof when the temperature mentioned above descended, that is a time constant is decreased. That is, in the former case, a flow amount of the refrigerant flowing into the inlet port of the evaporator is increased only gradually, and in the latter case, a flow amount of the refrigerant flowing into the inlet port of the evaporator is quickly decreased.

Here, since the valve is not quickly opened even when the temperature is decreased so as to quickly throttle the valve and the supply amount of the refrigerant to the evaporator is decreased, as a result the temperature is increased, the supply amount of the refrigerant to the evaporator is not rapidly increased.

In accordance with the structure mentioned above, it is possible to prevent the hunting from generating in the refrigerant cycle.

Since a hunting restricting characteristic of the thermal expansion valve with using the heat ballast member mentioned above is effective, it is widely used.

The hunting phenomenon mentioned above is different in accordance with a operating characteristic of an individual refrigerant cycle, in particular, there is a case that when a fine temperature change is made in the low pressure refrigerant fed out from the evaporator, a small pulsation is transmitted to the opening and closing operations of the valve member as it is, so that the valve operation becomes unstable and the hunting phenomenon can not be restricted even when using the heat ballast member is used.

SUMMARY OF THE INVENTION

Accordingly, an object of the present invention is to provide a thermal expansion valve which can prevent a hunting phenomenon even when a fine temperature change is made in a low pressure refrigerant fed out from an evaporator while maintaining the conventional operation without changing the conventional thermal expansion valve and can control an amount of a high pressure refrigerant fed out to the evaporator in to a stable operation.

In order to achieve the object mentioned above, in accordance with the present invention, there is provided a thermal expansion valve having a refrigerant passage from an evaporator toward a compressor formed in an inner portion thereof and a temperature sensing and pressure transmitting member installed in the passage having a heat sensing function and forming a hollow portion in an inner portion thereof, wherein a distal end of the hollow portion of the temperature sensing and pressure transmitting member is fixed to a center opening portion of a diaphragm constituting a power element portion for driving the temperature sensing and pressure transmitting member, an upper pressure chamber within the power element portion formed by the diaphragm and the hollow portion are communicated with each other so as to form a sealed space having a working fluid charged therein, and the thermal-transfer-delay means is provided between a heat ballast member received in the hollow portion and an inner wall of the hollow portion.

Further, in accordance with the present invention, there is provided a thermal expansion valve comprising a valve body having a passage for a liquid phase refrigerant to be decreased and a passage for a gas phase refrigerant from an evaporator toward a compressor, a power element portion mounted to the valve body, a valve member for adjusting a flow amount of a refrigerant flowing through an orifice provided in the passage for the liquid phase refrigerant, a diaphragm for constituting the power element portion, a temperature sensing and pressure transmitting member connected to the diaphragm and a shaft for connecting the temperature sensing and pressure transmitting member to the valve member, and the thermal expansion valve drives the valve member due to a heat sensing operation of the power element portion, wherein the temperature sensing and pressure transmitting member is formed in a hollow pipe shape, the hollow portion having a distal end mounted to a circular hole in a center portion of the diaphragm and an upper space of the diaphragm in the power element form a sealed space, and the thermal-transfer-delay means is provided between a heat ballast member received in the hollow portion of the temperature sensing and pressure transmitting member and an inner wall of the hollow portion.

In the thermal expansion valve in accordance with the present invention structured in the above manner, since the thermal-transfer-delay means is provided between the inner wall of the hollow portion in the temperature sensing and pressure transmitting member and the heat ballast member received in the hollow portion, a thermal transfer from the temperature sensing and pressure transmitting member to the heat ballast member is delayed, so that it is possible to further increase the time constant in comparison with the case in which only the heat ballast member is used. As a result, when the temperature of the temperature sensing and pressure transmitting member is increased, a further time delay is caused in a phase change from the liquid phase to the gas phase of a temperature corresponding working fluid, so that when the temperature of the temperature sensing and pressure transmitting member is decreased, the working fluid is not prevented from quickly changing from the gas phase to the liquid phase. Accordingly, since more time is required when the thermal expansion valve is operated in a direction of opening the valve and the operation is quickly performed when the thermal expansion valve is operated in an opposite direction of closing the valve, it is possible to more effectively prevent the hunting phenomenon of the thermal expansion valve.

Further, in the present invention, since only the thermal-transfer-delay means is used, it is possible to restrict the hunting phenomenon without modifying the conventional thermal expansion valve, so that it is possible to decrease an assembling cost.

DESCRIPTION OF THE PREFERRED EMBODIMENTS

A description will now be given below of an embodiment of a thermal expansion valve in accordance with the present invention with reference to the accompanying drawing.

Figure 1:
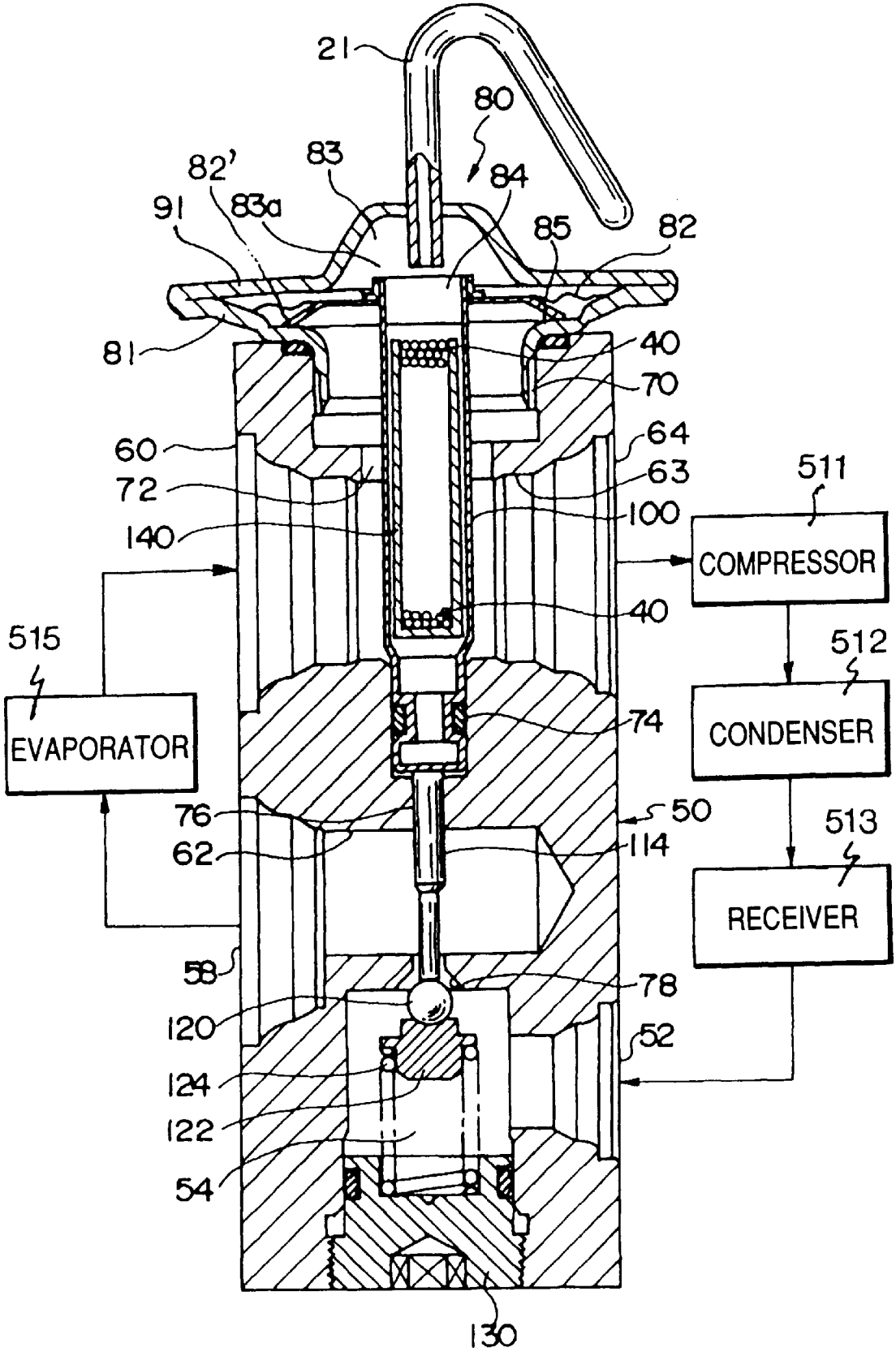
FIG. 1 is a cross sectional view which shows an embodiment in accordance with the present invention.

FIG. 1 is a vertical cross sectional view which shows an embodiment of a thermal expansion valve in accordance with the present invention. In the present embodiment, since only a structure of a temperature sensing and pressure transmitting member is different from that of the conventional thermal expansion valve, the same reference numerals are attached to the elements having the same functions as those of the conventional thermal expansion valve and a description will be omitted of the portions which performs the same function of those of the conventional thermal expansion valve.

In FIG. 1, reference numeral 140 denotes a thermal-transfer-delay means which is made of, for example, a resin material, a stainless steel or the like, in the drawing, a resin tube made of a polyacetal is shown, and is provided between the heat ballast member 40 and the inner wall of the hollow portion in the temperature sensing and pressure transmitting member 100. Accordingly, the ballast member 40 and the resin tube 140 are provided in the hollow portion of the temperature sensing and pressure transmitting member 100. In the present embodiment, the resin tube 140 is provided within a range in which the heat ballast member 40 charged in the hollow portion 84 exists, however, it is a matter of course that the range for the resin tube may be set to a partial range of the heat ballast member 40 in correspondence to a degree of the hunting phenomenon.

Accordingly, in the present embodiment, an integral space 83*a* between the power element portion 80 and the temperature sensing and pressure transmitting member 100 is formed by charging a granular activated carbon as the heat ballast member 40 and welding the temperature sensing and pressure transmitting member 100 charged with the granular activated carbon and the diaphragm 82 in the manner mentioned above. A small pipe 21 (a charged capillary) for charging a temperature corresponding working fluid is mounted to a cover 91 forming the space 83*a*, a deaeration is performed from an end (which is sealed in the drawing) of the small pipe 21, the working fluid is charged after deaeration and one end of the small pipe 21 is sealed. In this case, needless to say, the plug body may be employed in place of the small pipe 21 in the same manner as the conventional manner so as to seal.

A pressure within the space 83*a* structured in the manner mentioned above can be expressed by a function of the refrigerant gas in the second passage 63 to which the temperature sensing and pressure transmitting member 100 is exposed, so that the pressure can be approximated to a linear equation of a temperature in a significantly wide temperature range.

Further, a heat transmission to the heat ballast material is delayed by an existence of the resin tube 140 in both cases that the temperature of the refrigerant discharged from the outlet port of the evaporator ascends and descends, whereby it is possible to increase the time constant. Accordingly, this further restricts the hunting operation of the thermal expansion valve caused by an influence of the disturbance.

Still further, for example, even in the case of using an alumina silica sintered body for the heat ballast material, when the temperature of the refrigerant discharged from the outlet port of the evaporator ascends (when a heating degree is ascended), the heat tramsmission to the heat ballast member is delayed by an existence of the resin material, so that the change from the liquid phase to the gas phase (the gasification) of a temperature corresponding working fluid in the upper chamber 83 of the power element portion 80 which is inserted into a multiplicity of fine holes in the heat ballast member 40 is delayed, and further, when the temperature mentioned above descends (when the heating degree is descended), the working gas in the space except the upper chamber 83 and the heat ballast member 40 is not prevented from quickly changing from the gas phase to the liquid phase (liquefying) on the wall surfaces. That is, in the former case, in comparison with the case of using only the heat ballast member, the flow amount of the refrigerant flowing into the inlet port of the evaporator is increased only further gradually, and in the latter case, it is possible to quickly decrease the flow amount of the refrigerant flowing into the inlet port of the evaporator.

In the embodiment in accordance with the present invention mentioned above, the time constant can, needless to say, be selected by suitably selecting a material and a thickness of the time constant delaying material.

As is understood from the above description, since the thermal expansion valve in accordance with the present invention is structured such that the hunting phenomenon is restricted by using the resin and the heat ballast member in the hollow portion of the temperature sensing and pressure transmitting member, it is possible to increase the time constant and it is possible to more effectively restrict the hunting phenomenon.

Further, since the thermal expansion valve in accordance with the present invention can be obtained without widely changing the conventional thermal expansion valve, it is possible to facilitate the assembling process, decrease a producing cost and increase a reliability.

Figure 2:
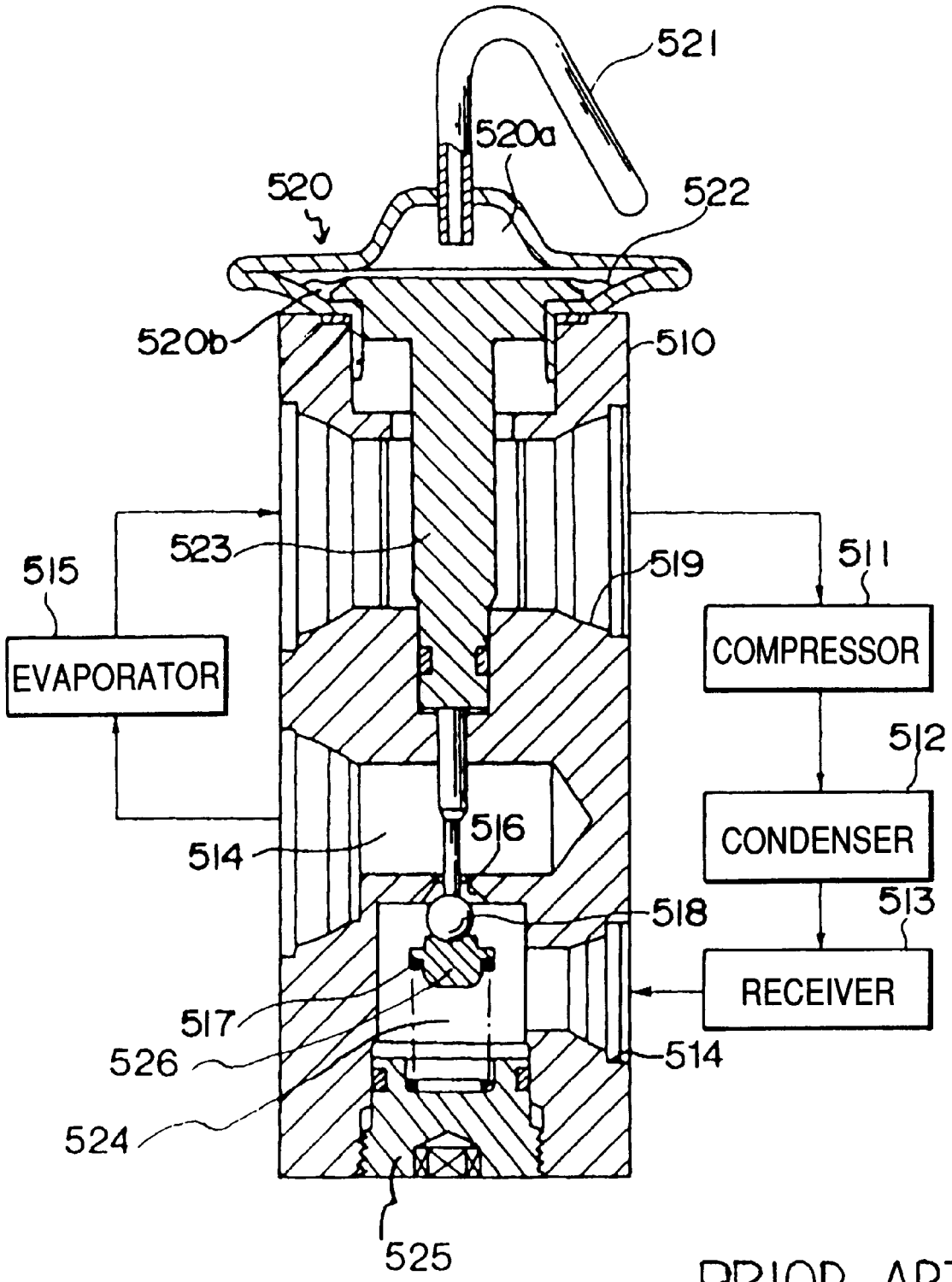
FIG. 2 is a cross sectional view which shows a conventional apparatus.
Figure 3:
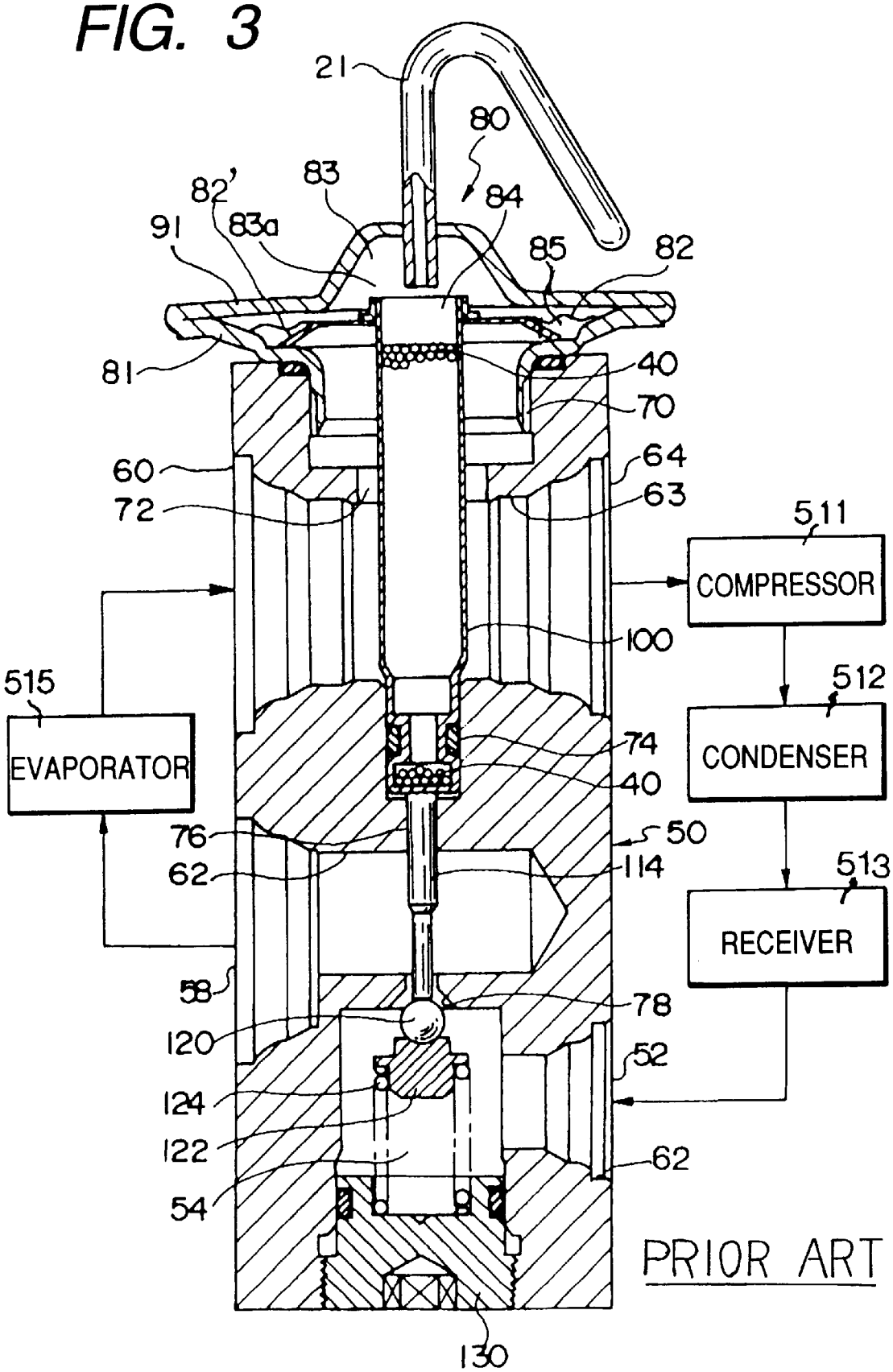
FIG. 3 is a cross sectional view which shows a conventional apparatus.

FIG. 1
511 COMPRESSOR
512 CONDENSER
513 RECEIVER
515 EVAPORATOR
FIG. 2
511 COMPRESSOR
512 CONDENSER
513 RECEIVER
515 EVAPORATOR
FIG. 3
511 COMPRESSOR
512 CONDENSER
513 RECEIVER
515 EVAPORATOR

What is claimed is:

1. A thermal expansion valve having a refrigerant passage from an evaporator toward a compressor formed in an inner portion thereof and a temperature sensing and pressure transmitting member installed in the passage having a heat sensing function and forming a hollow portion in an inner portion thereof, wherein a distal end of the hollow portion of the temperature sensing and pressure transmitting member is fixed to a center opening portion of a diaphragm constituting a power element portion for driving the temperature sensing and pressure transmitting member, an upper pressure chamber within the power element portion formed by the diaphragm and the hollow portion are communicated with each other so as to form a sealed space having a working fluid charged therein, and a thermal-transfer-delay means is provided between a heat ballast member received in the hollow portion and an inner wall of the hollow portion.

2. A thermal expansion valve comprising a valve body having a passage for a liquid phase refrigerant to be decreased and a passage for a gas phase refrigerant from an evaporator toward a compressor, a power element portion mounted to the valve body, a valve member for adjusting a flow amount of a refrigerant flowing through an orifice provided in the passage for the liquid phase refrigerant, a diaphragm for constituting the power element portion, a temperature sensing and pressure transmitting member connected to the diaphragm and a shaft for connecting the temperature sensing and pressure transmitting member to the valve member, and the thermal expansion valve drives the valve member due to a temperature sensing operation of the power element portion, wherein the temperature sensing and pressure transmitting member is formed in a hollow pipe shape, the hollow portion having a distal end mounted to a circular hole in a center portion of the diaphragm and an upper space of the diaphragm in the power element form a sealed space, and the thermal-transfer-delay means is provided between a heat ballast member received in the hollow portion of the temperature sensing and pressure transmitting member and an inner wall of the hollow portion.

3. A thermal expansion valve as claimed in claim 1, wherein the thermal-transfer-delay means is provided in a range in which the heat ballast member of the hollow portion is received.

4. A thermal expansion valve as claimed in claim 2, wherein the thermal-transfer-delay means is provided in a range in which the heat ballast member of the hollow portion is received.

* * * * *